US010859360B2

(12) United States Patent
Choi

(10) Patent No.: US 10,859,360 B2
(45) Date of Patent: Dec. 8, 2020

(54) ELECTRONIC DELAY DETONATOR LOGGING CONTROL DEVICE AND METHOD THEREFOR

(71) Applicant: HANWHA CORPORATION, Seoul (KR)

(72) Inventor: Jeong Ho Choi, Sejong (KR)

(73) Assignee: HANWHA CORPORATION, Seoul (KR)

( * ) Notice: Subject to any disclaimer, the term of this patent is extended or adjusted under 35 U.S.C. 154(b) by 0 days.

(21) Appl. No.: 16/477,622

(22) PCT Filed: Jan. 20, 2017

(86) PCT No.: PCT/KR2017/000743
§ 371 (c)(1),
(2) Date: Jul. 12, 2019

(87) PCT Pub. No.: WO2018/135682
PCT Pub. Date: Jul. 26, 2018

(65) Prior Publication Data

US 2019/0368851 A1 Dec. 5, 2019

(51) Int. Cl.
*F42D 1/055* (2006.01)
*F42D 3/04* (2006.01)

(52) U.S. Cl.
CPC ..... *F42D 1/055* (2013.01); *F42D 3/04* (2013.01)

(58) Field of Classification Search
CPC ... F42D 1/05; F42D 1/055; F42D 1/06; F42D 3/04
USPC ..... 102/215, 311
See application file for complete search history.

(56) References Cited

U.S. PATENT DOCUMENTS

2003/0029344 A1 2/2003 Eddy et al.
2006/0262480 A1* 11/2006 Stewart ..... F41A 17/066 361/251
2006/0272536 A1* 12/2006 Lownds ..... F42D 1/045 102/215
2008/0236432 A1 10/2008 Teowee
(Continued)

FOREIGN PATENT DOCUMENTS

KR 10-2004-0017225 A 2/2004
KR 10-1016538 B1 2/2011
KR 10-1394453 B1 5/2014

OTHER PUBLICATIONS

International Search Report dated Sep. 15, 2017, issued in counterpart application No. PCT/KR2017/000743, w/ English translation (7 pages).

*Primary Examiner* — Bret Hayes
(74) *Attorney, Agent, or Firm* — Westerman, Hattori, Daniels & Adrian, LLP

(57) ABSTRACT

An electronic delay detonator logging control device and a method therefor are disclosed. The state and the connection of a plurality of electronic delay detonators connected in parallel and a trunk line are inspected before blasting so as to check for an incomplete connection and prevent a partial misfire. A log counter is assigned to the plurality of electronic delay detonators such that the plurality of electronic delay detonators can be blasted in desired blasting patterns or in sequence. In the event of a failure, a logging recovery mode is operated so as to recover connection information of the plurality of electronic delay detonators.

15 Claims, 6 Drawing Sheets

(56) References Cited

U.S. PATENT DOCUMENTS

2009/0193993 A1* 8/2009 Hummel ..... F42D 3/04
102/215

* cited by examiner

ELECTRONIC DELAY DETONATOR LOGGING CONTROL DEVICE AND METHOD THEREFOR

TECHNICAL FIELD

The present invention relates to an electronic delay detonator logging control device and a method therefor and, more particularly, to an electronic delay detonator logging control device and a method therefor, by which the connection of a plurality of electronic delay detonators connected in parallel and a trunk line is inspected before blasting, and a log counter is assigned so that the plurality of electronic delay detonators can be controlled in desired blast patterns or in sequence.

BACKGROUND ART

In general, rocks are excavated when constructing a lower foundation of a high-rise building or other large-scale ground structure, or constructing an underground structure such as a subway or an underground tunnel. In this case, the rock is blasted with explosives such as dynamite and then crushed. The rock blasting is performed by excavating a number of blast holes in rock masses and charging explosives therein.

Most of the current blasting excavations have been carried out using electronic and non-electrical detonators. In terms of electronic and non-electrical detonators, there are disadvantages that an error of blasting delay time is large for each blast hole, and a method of dividing the delay time is inconveniently used because a connection detonator (bunch connector) or a surface delay detonator (TLD; trunk-line detector) is used in a place where there is a larger number of blast holes, such as a tunnel.

In particular, an electronic detonator has an electronic chip (IC-chip) in place of a chemical retarder (Pyrotechnic) built therein, thereby allowing a desired delay time to be used as an interval of 1 ms from 0 to 25,000 ms. In addition, since the electronic detonator is very accurate since the error is as low as about 0.1%, it is possible to prevent superimposition/amplification of vibration due to errors in the electronic and non-electrical detonator blasting in the related art, thereby having very good effect of reducing vibration.

However, the electronic detonator is difficult to use, since it has no criteria for the delay time setting method, and the delay time input methods are different. In other words, it takes a lot of time to set the delay time when the electronic detonator is installed and a problem occurs due to the input error of the blast delay time.

DISCLOSURE

Technical Problem

In order to solve the above problems, the present invention has an objective to provide an electronic delay detonator logging control device and a method therefor, by which the connection of a plurality of electronic delay detonators connected in parallel and a trunk line is inspected before blasting.

In addition, the present invention has an objective to provide an electronic delay detonator logging control device and a method therefor, by which a log counter is assigned so that the plurality of electronic delay detonators can be controlled in desired blast patterns or in sequence.

In addition, the present invention has an objective to provide an electronic delay detonator logging control device and a method therefor, by which in the event of a failure, a logging recovery mode is operated so that the plurality of electronic delay detonators can recover log counter assignment contents.

Technical Solution

In order to achieve the objectives, an electronic delay detonator logging control device according to the present invention includes: a logging mode operation unit operating a logging mode when a controller is interconnected with a trunk line connected to a plurality of electronic delay detonators; a detonator detection signal transmission unit transmitting a detonator detection signal to the plurality of electronic delay detonators through the trunk line when the logging mode is operated; a detection reception response signal reception unit receiving a detonator detection reception response signal for a detonator detection signal transmitted from at least any one electronic delay detonator to which a log counter is not assigned among the plurality of electronic delay detonators; a log counter transmission unit issuing and transmitting the log counter to at least any one of the electronic delay detonators when the detonator detection reception response signal is received; a counter reception response signal reception unit receiving a counter reception response signal for a log counter reception transmitted from at least any one of the electronic delay detonators that receives and records the issued log counter; and a logging mode termination unit terminating the logging mode via user operation.

In addition, the log counter transmission unit may issue the log counter including a unique ID for the controller and a sequence of the issued log counter.

In addition, the counter reception response signal reception unit may include: a signal number counting unit counting the number of detonator detection reception response signals received; a counter deletion request signal transmission unit transmitting a counter deletion request signal for deleting a recently issued log counter to at least any one of the electronic delay detonators when two or more counter reception response signals are received for the log counter reception; and a counter deletion performance signal reception unit receiving a counter deletion performance signal for the counter deletion request signal transmitted from at least any one of the electronic delay detonators that receives the counter deletion request signal.

In addition, when the logging mode is terminated by the user, the logging mode termination unit may transmit a logging mode termination instruction to the plurality of electronic delay detonators so that the electronic delay detonator receiving the instruction switches to an operation standby mode.

In addition, the device may further include a logging recovery mode operation unit operating a logging recovery mode when a failure occurs in the controller and a new controller is connected to the trunk line.

In addition, the logging recovery mode operation unit may include: a counter repeat instruction transmission unit transmitting a counter repeat instruction signal to the plurality of electronic delay detonators through the trunk line when the logging recovery mode is operated; and a log counter repeat signal reception unit receiving and recording a log counter repeat signal transmitted from the electronic delay detonator in a predetermined sequence.

In addition, the logging mode operation unit may operate the logging mode for the controller when the log counter repeat signal is received.

In addition, the electronic delay detonator may include: an activation mode operation unit connected in parallel to the trunk line and operating in an activation mode to perform charging within a predetermined time when the logging mode is operated; a state checking unit checking whether the log counter is assigned when the charging is completed; a detection response signal transmission unit transmitting the detonator detection reception response signal for the detonator detection signal when the log counter is not assigned and not transmitting the detonator detection reception response signal for the detonator detection signal when the log counter is assigned; a log counter receiving unit receiving and recording the issued log counter when the log counter is not assigned, and ignoring the issued log counter when the log counter is assigned; a counter reception response signal transmission unit transmitting the counter reception response signal for the log counter reception when the issued log counter is received and recorded; and an operation standby mode switching unit terminating the activation mode and switching to an operation standby mode, when the logging mode is terminated.

In addition, the electronic delay detonator may include, when the counter deletion request signal for deleting a recently issued log counter is received, a counter deletion performance unit deleting the corresponding log counter upon receiving and recording the corresponding log counter; and after the deleting of the log counter, a counter deletion performance signal transmission unit transmitting a counter deletion performance signal for the counter deletion request signal.

In addition, the electronic delay detonator may include a correction standby mode switching unit operating in a logging recovery mode and receiving a counter repeat instruction signal; and a counter repeat signal transmission unit transmitting a log counter repeat signal in a predetermined sequence.

In addition, the electronic delay detonator may further include a log counter issue request signal transmission unit for transmitting a log counter issue request signal to the log counter transmission unit when it is recognized that the controller is set to a reception mode, so that, when the log counter is not assigned, the log counter transmitted from the log counter transmission unit that receives the log counter issue request signal is received and recorded through the log counter receiving unit.

In order to achieve the above objectives, an electronic delay detonator logging control method includes, by a logging mode operation unit, operating a logging mode when a controller is interconnected with a trunk line connected to a plurality of electronic delay detonators; by a detonator detection signal transmission unit, transmitting a detonator detection signal to the plurality of electronic delay detonators through the trunk line when the logging mode is operated; by a detection reception response signal reception unit, receiving a detonator detection reception response signal for a detonator detection signal transmitted from at least any one electronic delay detonator to which a log counter is not assigned among the plurality of electronic delay detonators; by a log counter transmission unit, issuing and transmitting the log counter to at least any one of the electronic delay detonators when the detonator detection reception response signal is received; by a counter reception response signal reception unit, receiving a counter reception response signal for a log counter reception transmitted from at least any one of the electronic delay detonators that receives and records the issued log counter; and by a logging mode termination unit, terminating the logging mode via user operation.

In addition, after the operating of the logging mode when the controller is interconnected with the trunk line connected to the plurality of electronic delay detonators, the method may further include: allowing the electronic delay detonator to be connected in parallel to the trunk line and operating in an activation mode to perform charging within a predetermined time when the logging mode is operated; allowing the electronic delay detonator to check whether the log counter is assigned when the charging is completed; allowing the electronic delay detonator to transmit a detonator detection reception response signal for a detonator detection signal when the log counter is not assigned and not transmitting the detonator detection reception response signal for the detonator detection signal when the log counter is assigned; allowing the electronic delay detonator to receive and record the issued log counter when the log counter is not assigned, and ignore the issued log counter when the log counter is assigned; allowing the electronic delay detonator to transmit a counter reception response signal for a log counter reception when the issued log counter is received and recorded; and allowing the electronic delay detonator to terminate the activation mode and switch to an operation standby mode when the logging mode is terminated.

In addition, after the reception of the counter reception response signal for the log counter reception transmitted from at least any one of the electronic delay detonators that receives and records the issued log counter, the method may further include counting the number of the received detonator detection reception response signals; transmitting a counter deletion request signal for deleting a recently issued log counter to at least one of the electronic delay detonators when two or more counter reception response signals for a log counter reception are received; and receiving a counter deletion performance signal for the counter deletion request signal transmitted from at least one electronic delay detonator that receives the counter deletion request signal.

In addition, after the reception of the counter reception response signal for the log counter reception transmitted from at least any one of the electronic delay detonators that receives and records the issued log counter, the method may further include allowing the electronic delay detonator to delete the corresponding log counter upon receiving and recording the corresponding log counter when a counter deletion request signal for deleting a recently issued log counter is received; and allowing the electronic delay detonator to delete the log counter and then transmit a counter deletion performance signal for the counter deletion request signal.

In addition, after the terminating of the logging mode when the counter reception response signal is received, the method may further include: operating a logging recovery mode when a failure occurs in the controller and a new controller is connected to the trunk line, wherein the operating of the logging recovery mode when the failure occurs in the controller and the new controller is connected to the trunk line may include transmitting a counter repeat instruction signal to the plurality of electronic delay detonators through the trunk line when the logging recovery mode is activated; and receiving and recording a log counter repeat signal transmitted from the electronic delay detonator in a predetermined sequence.

In addition, after the terminating of the logging mode when the counter reception response signal is received, the method may further include allowing the electronic delay detonator to operate in a logging recovery mode to receive a counter repeat instruction signal; and allowing the electronic delay detonator to transmit the log counter repeat signal in a predetermined sequence.

Advantageous Effects

The electronic delay detonator logging control device and the method therefor according to the present invention has an effect that the connection of a plurality of electronic delay detonators connected in parallel and a trunk line is inspected before blasting so as to check for an incomplete connection and prevent a partial misfire, thereby inducing accurate blasting and improving the stability of the electronic delay detonator.

In addition, the present invention has an effect that a log counter is assigned to the plurality of electronic delay detonators such that the plurality of electronic delay detonators can be blasted in desired blasting patterns or in sequence.

In addition, according to the present invention, there is an effect that, in the event of a failure, a logging recovery mode is operated so as to recover connection information of the plurality of electronic delay detonators, and thus worker inconvenience is minimized during reconnection and re-registration operations such that work efficiency and convenience can be maximized.

DESCRIPTIONS OF REFERENCE NUMERALS IN DRAWINGS

Figure 1:
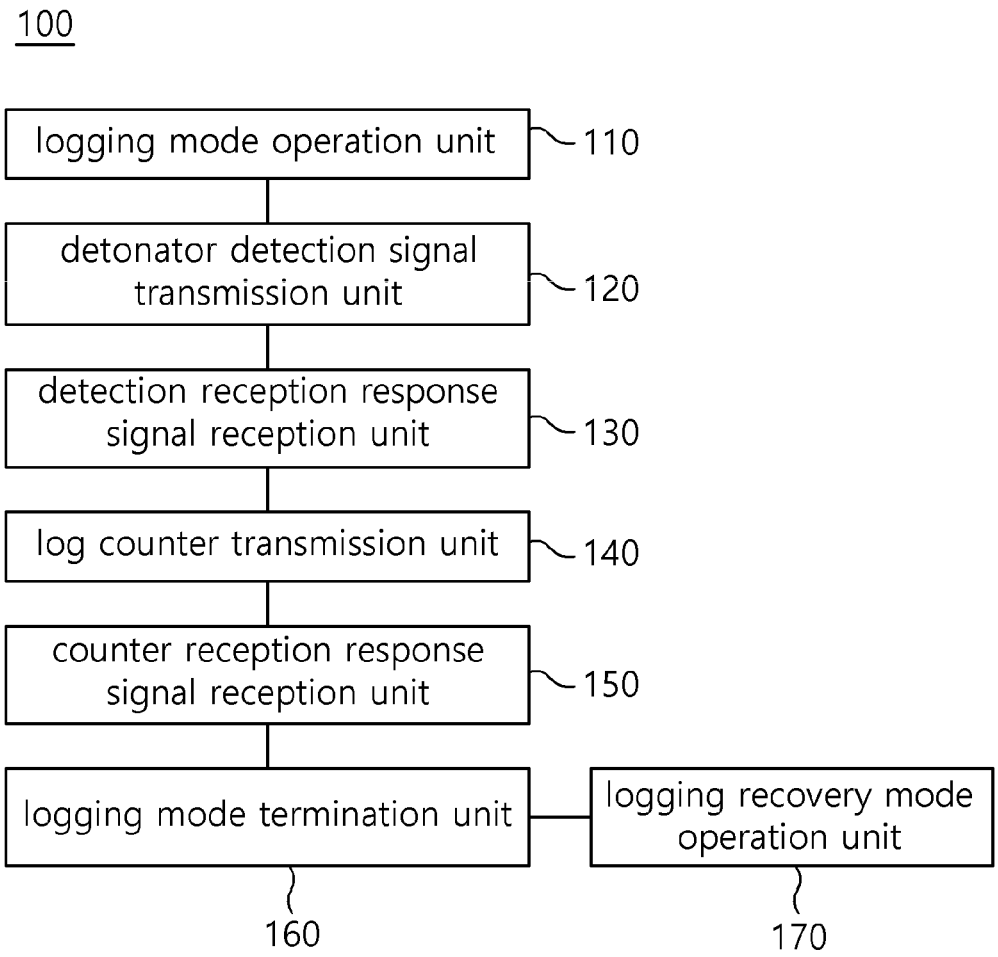
FIG. 1 is a view illustrating a configuration of an electronic delay detonator logging control device according to the present invention.

100: electronic delay detonator logging control device
110: logging mode operation unit
120: detonator detection signal transmission unit
130: detection reception response signal reception unit
140: log counter transmission unit
150: counter reception response signal reception unit
160: logging mode termination unit
170: logging recovery mode operation unit
200: electronic delay detonator

BEST MODE

While the invention is susceptible to various modifications and alternative embodiments, specific embodiments thereof are shown by way of example in the drawings and will herein be described in detail.

It should be understood, however, that the invention is not intended to be limited to the particular embodiments, but includes all modifications, equivalents, and alternatives falling within the spirit and scope of the invention. Like reference numerals are used for like elements in describing each drawing.

It is to be understood that when an element is referred to as being "coupled" or "connected" to another element, it may be not only directly coupled or connected to the other element, but also connected with another element in between. On the other hand, when an element is referred to as being "directly coupled" or "directly connected" to another element, it should be understood that there are no other elements in between.

The terminology used in this application is used only to describe a specific embodiment and is not intended to limit the invention. The singular expressions include plural expressions unless the context clearly dictates otherwise. In the present application, the terms "comprising", "having", or the like are used to specify that there is a feature, a number, a step, an operation, an element, a component or a combination thereof described in the specification, but do not preclude the presence or addition of one or more other features, integers, steps, operations, elements, components, or combinations thereof.

Hereinafter, preferred embodiments of the present invention will be described in detail with reference to the accompanying drawings. Hereinafter, the same reference numerals will be used for the same constituent elements in the drawings, and redundant explanations for the same constituent elements will be omitted.

The electronic delay detonator logging control device according to the present invention inspects the connection of a plurality of electronic delay detonators and connected in parallel and a trunk line before blasting and assigns a log counter so as to analyze the plurality of electronic delay detonators in a desired blasting pattern or in sequence. Although the electronic delay detonator logging control device described in the following description has been described as a separate configuration from the controller, it may be integrated with the controller by changing the design.

FIG. 1 is a view illustrating a configuration of an electronic delay detonator logging control device according to the present invention.

Referring to FIG. 1, the electronic delay detonator logging control device 100 according to the present invention includes a logging mode operation unit 110, a detonator detection signal transmission unit 120, a detection reception response signal reception unit 130, a log counter transmission unit 140, a counter reception response signal reception unit 150, a logging mode termination unit 160, and a logging recovery mode operation unit 170.

The logging mode operation unit 110 operates a logging mode when a controller is connected to a trunk line that is connected to a plurality of electronic delay detonators. Here, the trunk line has a plurality of branch lines connected at intervals.

The detonator detection signal transmission unit 120 is provided so that a power source is connected to the trunk line when the logging mode is operated, and periodically transmits a detonator detection signal to the plurality of electronic delay detonators through the trunk line. Here, the electronic delay detonator operates in the activation mode to perform charging within a predetermined time when the logging mode is operated, and checks whether a log counter is assigned when the charging is completed.

The detection reception response signal reception unit 130 receives a detonator detection reception response signal for a detonator detection signal transmitted from any one electronic delay detonator to which the log counter is not assigned among the plurality of electronic delay detonators. Here, the electronic delay detonator transmits a detonator detection reception response signal for the detonator detection signal when the log counter is not assigned, and does not transmit the detonator detection reception response signal for the detonator detection signal when the log counter is assigned. Herein, the detonator detection reception response signal does not include the ID of the corresponding electronic delay detonator.

When receiving the detonator detection reception response signal, the log counter transmission unit 140 issues and transmits the log counter to at least one electronic delay detonator. Herein, the log counter may include a unique ID for the controller and the sequence of the issued log counters. For example, in the case of the 101st detonator of a controller No. 2, it is possible that the log counter is issued with 2C0101.

The counter reception response signal reception unit 150 receives a counter reception response signal for a log counter reception transmitted from at least any one electronic delay detonator that receives and records the issued log counter. Here, when the log counter is not assigned, the electronic delay detonator receives the issued log counter and records the same in a separate memory. When the log counter is assigned, the electronic delay detonator ignores the issued log counter.

Meanwhile, when the counter reception response signal for the log counter reception is received from two or more electronic delay detonators at the same time, the counter reception response signal reception unit 150 informs the outside of the failure and transmits a counter deletion request signal for deleting a log counter recently issued in at least one electronic delay detonator. In addition, the counter reception response signal reception unit 150 receives a counter deletion execution signal for the counter deletion request signal transmitted from at least any one electronic delay detonator that has received the counter deletion request signal to allow the electronic delay detonator to delete the corresponding log counter.

When the logging mode of the controller is terminated by the user, the logging mode termination unit 160 transmits a logging mode termination instruction to the plurality of electronic delay detonators so that the electronic delay detonators receiving the instruction are such that the activation mode is terminated and switched to a standby mode.

The logging recovery mode operation unit 170 operates a logging recovery mode when a failure occurs in the controller and a new controller is connected to the trunk line.

When the logging recovery mode is operated, the logging recovery mode operation unit 170 transmits a counter repeat instruction signal to the plurality of electronic delay detonators through the trunk line and transmits an internal clock correction instruction signal to the plurality of electronic delay detonators, and receives and records the log counter repeat signal which is transmitted in a predetermined sequence, from the electronic delay detonator which receives the internal clock correction instruction signal. Here, the first electronic delay detonator transmits its own log counter repeat signal at 0 ms, the second electronic delay detonator at 30 ms, and the third electronic delay detonator at 60 ms, assuming that the predetermined sequence and spacing are 30 ms. Meanwhile, the logging mode operation unit 110 may operate the logging mode for the controller when the log counter repeat signal is received.

Meanwhile, when the power source is turned off during the logging mode or the logging recovery mode, the log counter state of the electronic delay detonator is preserved, and the controller and the electronic delay detonator logging control device store the last operation information.

Figure 2:
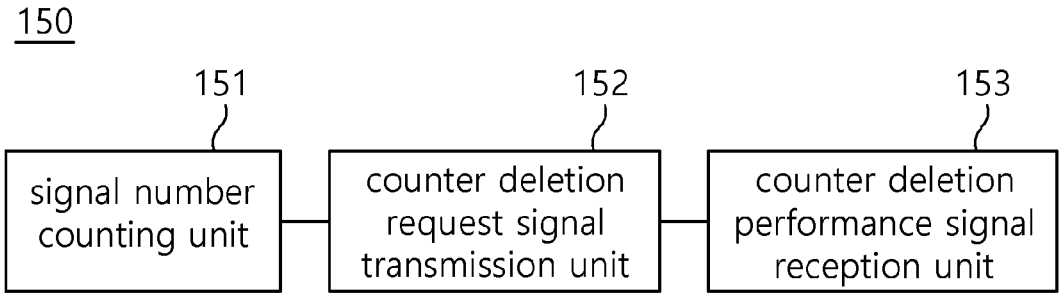
FIG. 2 is a view illustrating a detailed configuration of a counter reception response signal receiving unit employed in the electronic delay detonator logging control device according to the present invention.

FIG. 2 is a view illustrating a detailed configuration of a counter reception response signal receiving unit employed in the electronic delay detonator logging control device according to the present invention.

Referring to FIG. 2, the counter reception response signal reception unit 150 according to the present invention receives a detonator detection response signal for a detonator detection signal transmitted from at least any one electronic delay detonator to which the log counter is not assigned among a plurality of electronic delay detonators and transmits a counter deletion request signal when two or more counter reception response signals for the log counter reception are received.

For this purpose, the counter reception response signal reception unit 150 includes a signal number counting unit 151, a counter deletion request signal transmission unit 152, and a counter deletion performance signal reception unit 153.

The signal number counting unit 151 counts the number of received detonator detection reception response signals.

When two or more counter reception response signals for the log counter reception are received, the counter deletion request signal transmission unit 152 transmits the counter deletion request signal for deleting the recently issued log counter to at least one electronic delay detonator.

The counter deletion performance signal reception unit 153 receives a counter deletion performance signal for a counter deletion request signal transmitted from at least any one electronic delay detonator that received the counter deletion request signal. Herein, the counter deletion performance signal is periodically sent from the electronic delay detonator, and when the corresponding signal is received, the controller displays a message that commands to remove the detonator which was last connected. This message is displayed until the detonator is removed and thus the counter deletion performance signal is no longer received by the controller.

Meanwhile, when two or more counter reception response signals for the log counter reception are received, the counter reception response signal reception unit 153 may further include a display unit that displays whether or not there is an abnormality, although not shown in the drawings. The screen of the display may indicate the abnormality details and the counter deletion performance signal so that the additional connection operation is not carried out so as to remove the electronic delay detonator.

Figure 3:
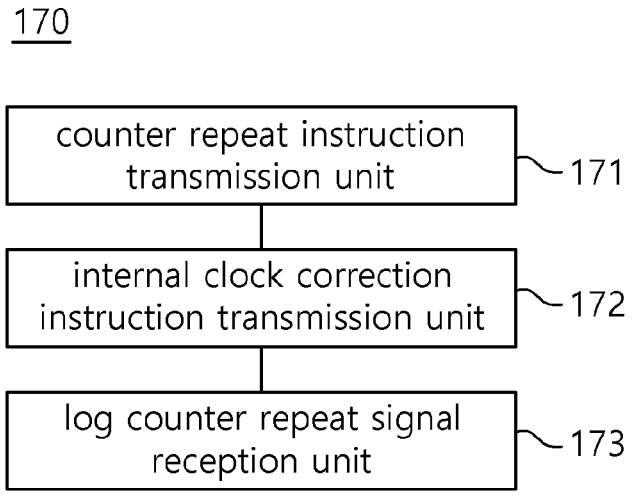
FIG. 3 is a view illustrating a detailed configuration of a logging recovery mode operation unit employed in the electronic delay detonator logging control device according to the present invention.

FIG. 3 is a view illustrating a detailed configuration of a logging recovery mode operation unit employed in the electronic delay detonator logging control device according to the present invention.

Referring to FIG. 3, the logging recovery mode operation unit 170 according to the present invention operates a logging recovery mode when a failure occurs in the controller and a new controller is connected to the trunk line.

To this end, the logging recovery mode operation unit 170 includes a counter repeat instruction transmission unit 171, an internal clock correction instruction transmission unit 172, and a log counter repeat signal reception unit 173.

The counter repeat instruction transmission unit 171 transmits a counter repeat instruction signal to the plurality of electronic delay detonators through the trunk line when the logging recovery mode is operated.

The internal clock correction instruction transmission unit 172 transmits an internal clock correction instruction signal to the plurality of electronic delay detonators.

The log counter repeat signal reception unit 173 receives and records the log counter repeat signal transmitted in the predetermined sequence from the electronic delay detonator which receives the internal clock correction instruction signal.

Figure 4:
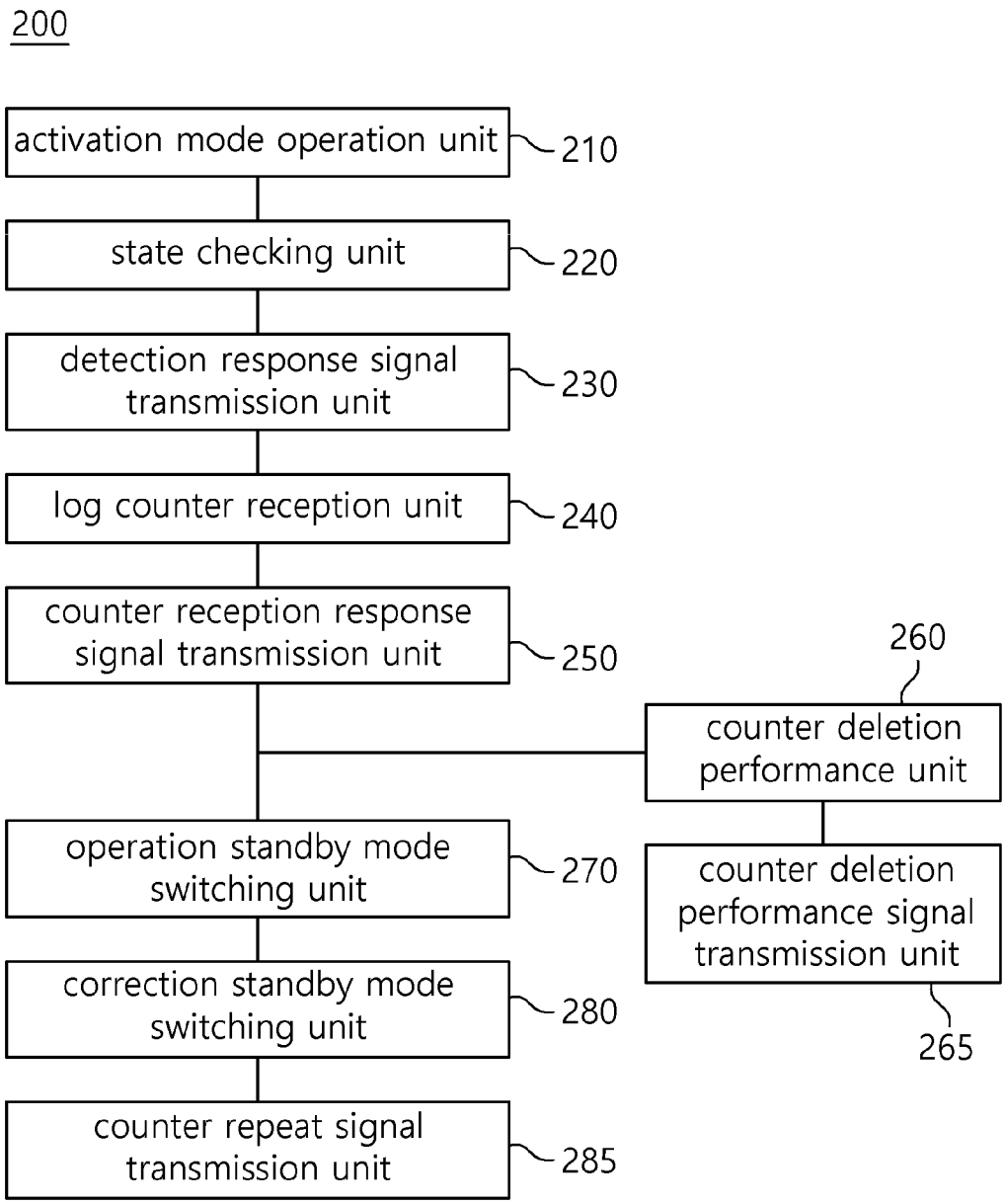
FIG. 4 is a view illustrating a configuration of an electronic delay detonator according to the present invention.

FIG. 4 is a view illustrating a configuration of an electronic delay detonator according to the present invention.

Referring to FIG. 4, an electronic delay detonator 200 according to the present invention includes an activation mode operation unit 210, a state checking unit 220, a detection response signal transmission unit 230, a log counter reception unit 240, a counter reception response signal transmission unit 250, a counter deletion performance unit 260, a counter deletion performance signal transmission unit 265, an operation standby mode switching unit 270, a correction standby mode switching unit 280, and a counter repeat signal transmission unit 285.

The activation mode operation unit 210 operates in the activation mode when the logging mode is operated, so as to perform the charging within a predetermined time.

The state checking unit 220 checks whether the log counter is assigned when charging is completed. Here, the electronic delay detonator logging control device periodically transmits a detonator detection signal to the plurality of electronic delay detonators through the trunk line.

The detection response signal transmission unit 230 transmits the detonator detection reception response signal for the detonator detection signal when the log counter is not assigned, and does not transmit the detonator detection reception response for the detonator detection signal when the log counter is assigned. Here, the electronic delay detonator logging control device receives the detonator detection reception response signal for the detonator detection signal transmitted from at least any one electronic delay detonator to which the log counter is not assigned and issues and transmits the log counter to the electronic delay detonator.

When the log counter is not assigned, the log counter reception unit 240 receives and records the issued log counter, and ignores the issued log counter when the log counter is assigned.

When the log counter reception unit 240 receives and records the issued log counter, the counter reception response signal transmitting unit 250 transmits the counter reception response signal for the log counter reception. Here, the electronic delay detonator logging control device receives the counter reception response signal for the log counter reception transmitted from at least any one electronic delay detonator that receives and recodes the issued log counter. Herein, when two or more counter reception response signals for the log counter reception are received, the electronic delay detonator logging control device transmits a counter deletion request signal for deleting the recently issued log counter to at least one electronic delay detonator.

When the counter deletion request signal for deleting the recently issued log counter is received, the counter deletion performance unit 260 deletes the corresponding log counter when the corresponding log counter is received and recorded.

The counter deletion performance signal transmitting unit 265 deletes the log counter, and then transmits a counter deletion performance signal for the counter deletion request signal. Here, the electronic delay detonator logging control device receives the counter deletion performance signal for the counter deletion request signal transmitted from at least any one electronic delay detonator that receives the counter deletion request signal.

When the logging mode is terminated, the operation standby mode switching unit 270 terminates the activation mode and switches to a standby mode. Herein, the electronic delay detonator to which the counter is normally assigned does not respond to instructions other than the counter deletion request signal above-described and the counter reading instruction signal described later.

The correction standby mode switching unit 280 is such that the logging recovery mode is operated and then switched to an internal clock correction standby mode when the counter repeat instruction signal is received. Here, the electronic delay detonator logging control device operates the logging recovery mode when a failure occurs in the controller and a new controller is connected to the trunk line, and transmits the counter repeat instruction signal and the internal clock correction instruction signal to the plurality of electronic delay detonator through the trunk line when the logging recovery mode is operated.

The counter repeat signal transmission unit 285 receives the internal clock correction instruction signal and transmits the log counter repeat signal in a predetermined sequence. Here, the electronic delay detonator logging control device receives and records the log counter repeat signal that is transmitted, in a predetermined sequence, from the electronic delay detonator that receives the internal clock correction instruction signal.

Meanwhile, the electronic delay detonator further includes a log counter issue request signal transmission unit for transmitting a log counter issue request signal to the log counter transmission unit when it is recognized that the controller is set in the reception mode, thereby receiving and recording the log counter transmitted from the log counter transmission unit which receives the log counter issue request signal through the log counter reception unit when the log counter is not assigned.

Figure 5:
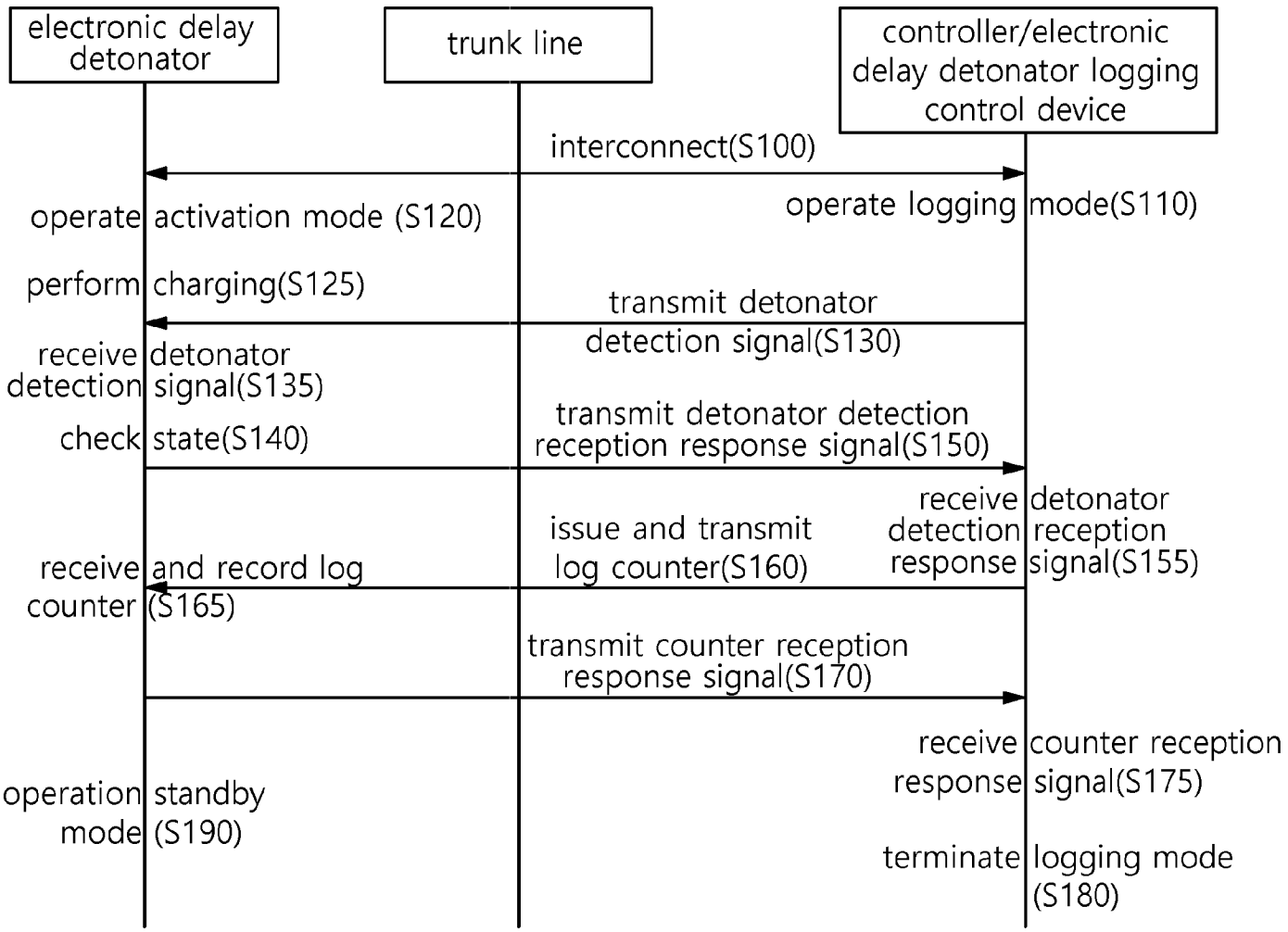
FIG. 5 is a flowchart illustrating a procedure of a logging mode operation in the electronic delay detonator logging control method according to the present invention.

FIG. 5 is a flowchart illustrating a procedure of a logging mode operation in the electronic delay detonator logging control method according to the present invention.

Referring to FIG. 5, a procedure of a logging mode operation in the electronic delay detonator logging control method according to the present invention is explained, in which the procedure is performed using the electronic delay detonator logging control device described above, and thus the redundant description will be omitted hereinafter.

First, the electronic delay detonators logging control device is interconnected to a trunk line that is connected to a plurality of electronic delay detonators (S100).

Next, a logging mode of the electronic delay detonator logging control device is operated (S110).

Next, the electronic delay detonator operates in the activation mode when the logging mode is operated, so as to perform charging within a predetermined time (S120 and S125).

Next, when the logging mode is operated, the electronic delay detonator logging control device is provided so that a power source is connected to the trunk line and a detonator detection signal is periodically transmitted to the plurality of electronic delay detonators through the trunk line (S130).

Next, the electronic delay detonator checks whether the log counter is assigned when the charging is completed (S140).

Next, the electronic delay detonator transmits a detonator detection reception response signal for the detonator detection signal when the log counter is not assigned, and transmits the detonator detection reception response signal for the detonator detection signal when the log counter is assigned (S150).

Next, the electronic delay detonator logging control device receives a detonator detection reception response signal for a detonator detection signal transmitted from at least any one electronic delay detonator to which a log counter is not assigned among the plurality of electronic delay detonators (S155).

Next, when the detonator detection reception response signal is received, the electronic delay detonator logging control device issues and transmits a log counter to at least one electronic delay detonator (S160).

Next, when the log counter is not assigned, the electronic delay detonator receives the issued log counter and records the received log counter in a separate memory, and when the log counter is assigned, the issued log counter is ignored (S165).

Next, when the electronic delay detonator completes receiving and recording the issued log counter, the electronic delay detonator transmits a counter reception response signal for the log counter reception (S170).

Next, the electronic delay detonator logging control device receives the counter reception response signal for the log counter reception transmitted from at least any one electronic delay detonator that receives and records the issued log counter (S175).

Next, the electronic delay detonator logging control device terminates the logging mode upon receiving the counter reception response signal (S180).

Next, the electronic delay detonator is such that the activation mode terminates and switches to the operation standby mode when the logging mode is terminated (S190).

Figure 6:
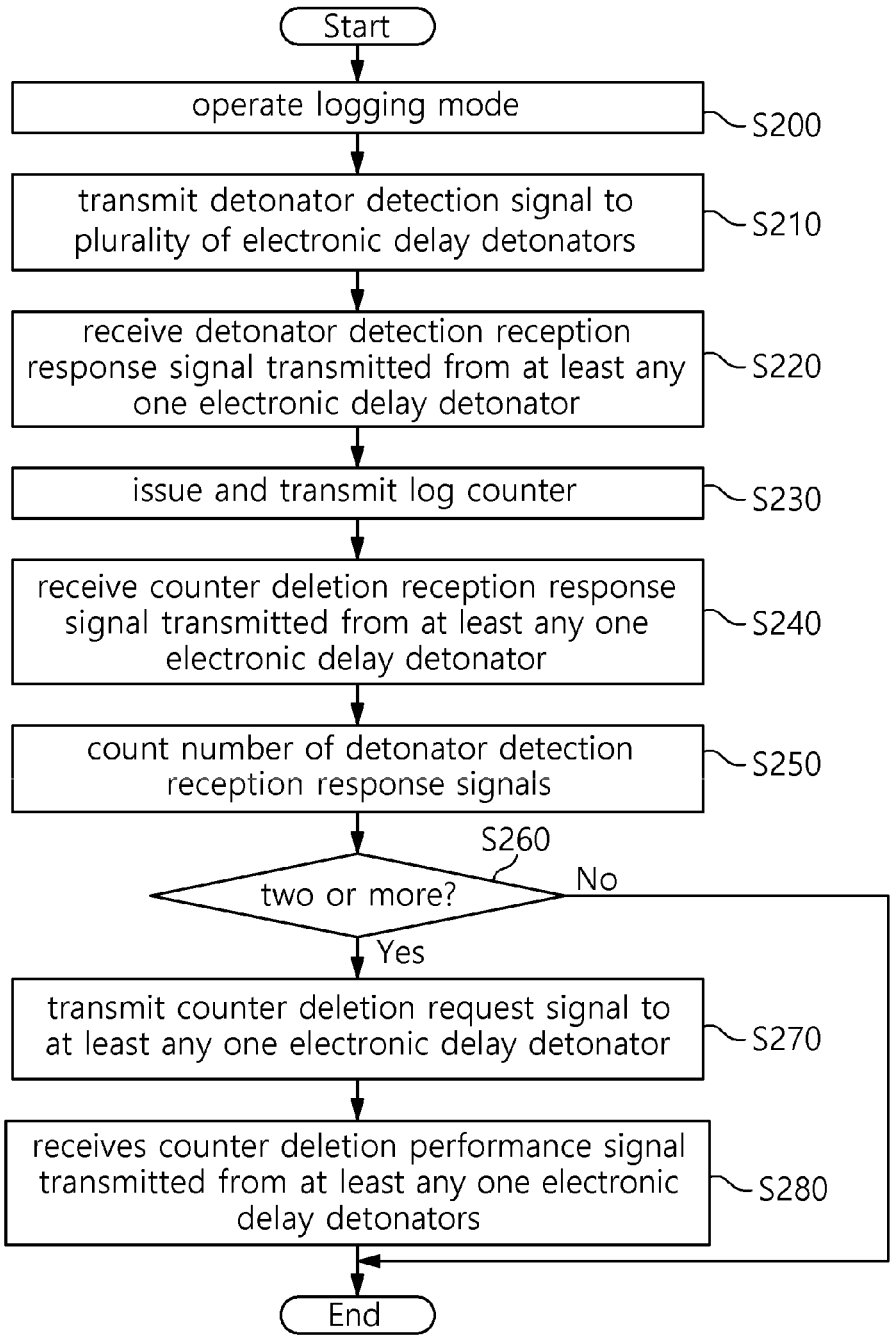
FIG. 6 is a flowchart illustrating a procedure of a log counter deletion request operation in the electronic delayed detonator logging control method according to the present invention.

FIG. 6 is a flowchart illustrating the procedure of a log counter deletion request operation in the electronic delayed detonator logging control method according to the present invention.

Referring to FIG. 6, a procedure of a log counter delete request operation in the electronic delay detonator logging control method according to the present invention is explained, in which the procedure is performed using the electronic delay detonator logging control device described above, and thus the redundant description will be omitted hereinafter.

First, when an electronic delay detonator logging control device is interconnected with a trunk line that is connected to a plurality of electronic delay detonators, the logging mode is operated (S200).

Next, when the logging mode is operated, the electronic delay detonator logging control device transmits a detonator detection signal to the plurality of electronic delay detonators through the trunk line (S210).

Next, the electronic delay detonator logging control device receives a detonator detection reception response signal for a detonator detection signal transmitted from at least any one electronic delay detonator to which the log counter is not assigned among the plurality of electronic delay detonators (S220).

Next, when receiving the detonator detection reception response signal, the electronic delay detonator logging control device issues and transmits a log counter to at least one electronic delay detonator (S230).

Next, the electronic delay detonator logging control device receives a counter reception response signal for the log counter reception transmitted from at least any one electronic delay detonator that receives and records the issued log counter (S240).

Next, the electronic delay detonator logging control device counts the number of detonator detection reception response signals that are received (S250).

In step S250, when one counter reception response signal is received for the log counter reception, the flow proceeds to step S280.

In step S250, when two or more counter reception response signals are received for the log counter reception, a counter deletion request signal is transmitted so as to delete the recently issued log counter to at least one electronic delay detonator (S260). In step S260, when the counter deletion request signal is received so as to delete the recently issued log counter, the electronic delay detonator deletes the corresponding log counter when the corresponding log counter is received and recorded, and transmits a counter deletion performance signal in response to the counter deletion request signal.

Next, the electronic delay detonator logging control device receives a counter deletion performance signal for the counter deletion request signal transmitted from at least any one electronic delay detonators that receives the counter deletion request signal (S270).

Finally, when the counter deletion performance signal that is generated periodically is no longer received, it means that the electronic delay detonator recording the counter is removed from the connection, in which the electronic delay detonator returns to the logging mode and thus transmits a detonator detection signal. In addition, the logging mode is terminated by a user. When the logging mode termination is selected, the logging mode termination instruction is transmitted to all the electronic delay detonators, and the electronic delay detonator that receives the instruction terminates the activation mode and switches to a standby mode.

Figure 7:
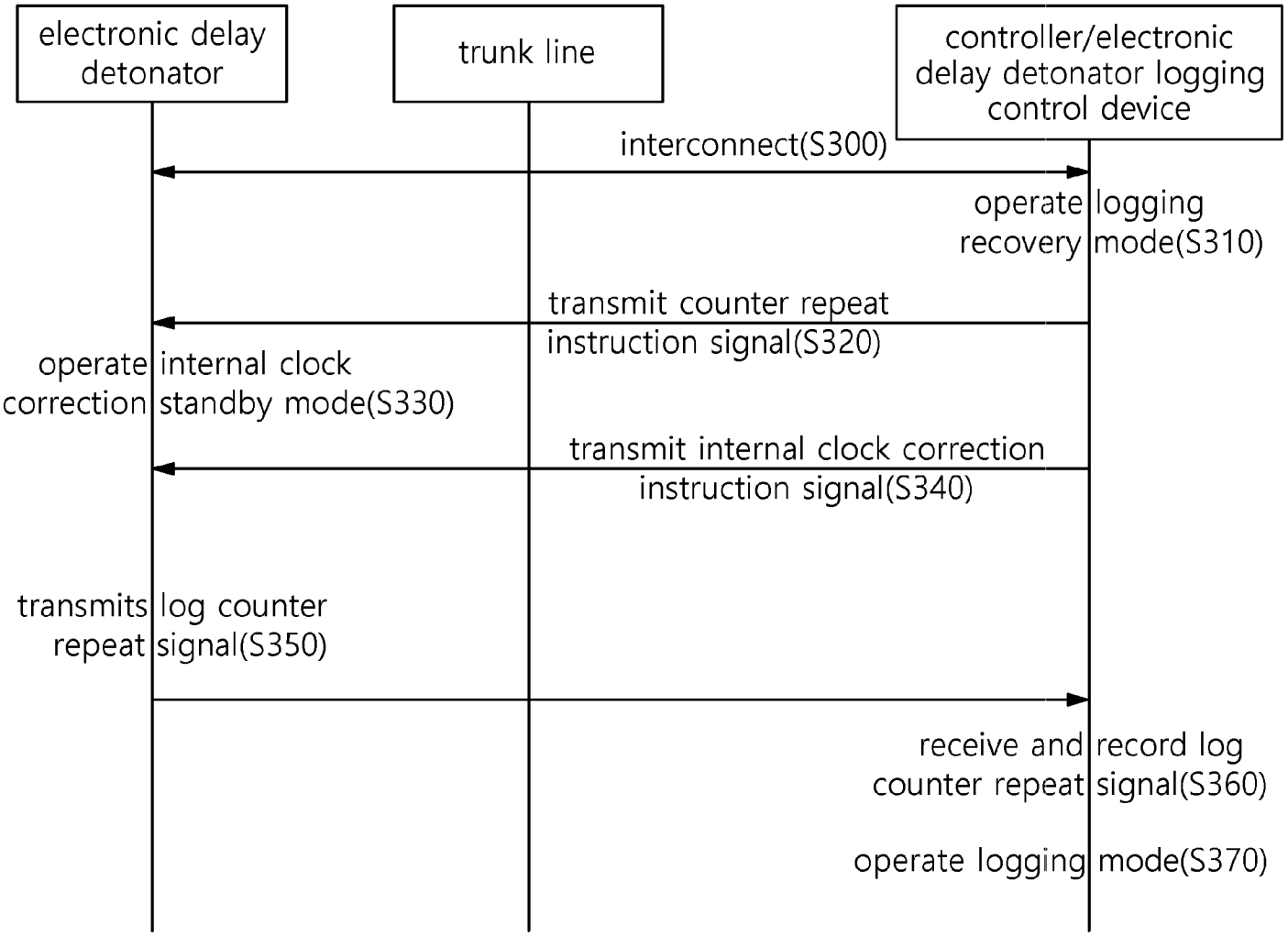
FIG. 7 is a flowchart illustrating the procedure of the logging recovery mode operation in the electronic delay detonator logging control method according to the present invention.

FIG. 7 is a flowchart illustrating a procedure of a logging recovery mode operation in the electronic delay detonator logging control method according to the present invention.

Referring to FIG. 7, a procedure of a logging recovery mode operation in the electronic delay detonator logging control method according to the present invention is explained, in which the procedure is performed using the electronic delay detonator logging control device described above, and thus the redundant description will be omitted hereinafter.

First, the electronic delay detonator logging control device connects a new controller to the trunk line when a failure occurs in the controller (S300).

Next, the electronic delay detonator logging control device operates a logging recovery mode (S310).

Next, when the logging recovery mode is operated, the electronic delay detonator logging control device transmits a counter repeat instruction signal to the plurality of electronic delay detonators through the trunk line (S320).

Next, when the counter repeat instruction signal is received, the electronic delay detonator switches the mode thereof to the internal clock correction standby mode (S330).

Next, the electronic delay detonator logging control device transmits an internal clock correction instruction signal to the plurality of electronic delay detonators (S340).

Next, the electronic delay detonator receives the internal clock correction instruction signal and transmits its own log counter repeat signal in a predetermined sequence (S350).

Next, the electronic delay detonator logging control device receives and records the log counter repeat signal transmitted in a predetermined sequence from the electronic delay detonator that receives the internal clock correction instruction signal (S360).

Finally, when the reception of the log counter repeat signal is completed, the electronic delay detonator logging control device may operate the logging mode for the controller (S370).

The electronic delay detonator logging control device and the method therefor according to the present invention has an effect that the connection of a plurality of electronic delay detonators connected in parallel and a trunk line is inspected before blasting so as to check for an incomplete connection and prevent a partial misfire, thereby inducing accurate blasting and improving the stability of the electronic delay detonator.

In addition, the present invention has an effect that a log counter is assigned to the plurality of electronic delay detonators such that the plurality of electronic delay detonators can be blasted in desired blasting patterns or in sequence.

In addition, according to the present invention, there is an effect that, in the event of a failure, a logging recovery mode is operated so as to recover connection information of the plurality of electronic delay detonators, and thus worker does not have to manually set the delay time, so that worker inconvenience can be minimized and work efficiency and convenience can be maximized.

The functional acts described hereinabove and embodiments of the present subject matter may be implemented in digital electronic circuitry, or in computer software, firmware, or hardware, including the structures disclosed in this specification and their structural equivalents, or in combinations of one or more thereof.

Embodiments of the subject matter described herein may be implemented as one or more computer program products, that is, one or more modules relating computer program instructions encoded on any tangible program medium for execution by, or to control the operation of, a data processing device. The tangible program medium may be a propagated signal or a computer readable medium. The propagated signal is an artificially generated signal, such as a machine-generated electrical, optical or electromagnetic signal, which is generated to encode information for transmission to a suitable receiver device for execution by a computer. The computer-readable medium can be a machine-readable storage device, a machine-readable storage substrate, a memory device, a composition of matters affecting a machine readable propagated signal, or a combination of one or more thereof.

A computer program (also known as a program, software, software application, script, or code) can be written in any appropriate form of a programming language, including compiled or interpreted languages, and it may be deployed in any appropriate form, including as a stand-alone program or as a module, component, subroutine, or other unit suitable for use in a computing environment.

A computer program does not necessarily correspond to a file in a file system. A program may be stored in a portion of a file that holds other programs or data (e.g., one or more scripts stored in a markup language document), in a single file dedicated to the program in question, or in multiple coordinated files (e.g., files that store one or more modules, sub programs, or portions of code).

A computer program may be deployed to be executed on one computer or on multiple computers that are located at one site or distributed across multiple sites and interconnected by a communication network.

Additionally, the logic flows and structural block diagrams described in this patent document describe corresponding actions and/or specific methods supported by corresponding functions and steps supported by the disclosed structural means and are used to build corresponding software structures and algorithms and their equivalents.

The processes and logic flows described herein may be performed by one or more programmable processors executing one or more computer programs to perform functions by operating on input data and generating outputs.

Processors suitable for the execution of a computer program include, by way of example, both general and special purpose microprocessors, and any one or more processors of any appropriate kind of digital computer. Generally, a processor will receive instructions and data from a read only memory or a random access memory or both.

The essential elements of a computer are a processor for performing instructions and one or more memory devices for storing instructions and data. Generally, a computer will also include or be operatively coupled to receive data from or transfer data to, or perform both of them, one or more mass storage devices for storing data, e.g., magnetic, magneto optical disks, or optical disks. However, a computer need not have such devices.

The description sets forth the best modes of the invention, and is provided to illustrate the invention and to enable those skilled in the art to make and use the invention. The written description is not intended to limit the invention to the specific terminology presented.

Thus, while the present invention has been described in detail with reference to the above examples, those skilled in the art will be able to make adaptations, modifications, and variations on these examples without departing from the scope of the present invention. In other words, in order to achieve the intended effect of the present invention, all the functional blocks shown in the drawings are separately included or all the steps shown in the drawings are not necessarily followed in the order shown.

The invention claimed is:

1. An electronic delay detonator logging control device, the device comprising:

a logging mode operation unit operating a logging mode when a controller is interconnected with a trunk line connected to a plurality of electronic delay detonators, at least one electronic delay detonator among the plurality of electronic delay detonators is not assigned a log counter, the other electronic delay detonators are assigned the log counter;

a detonator detection signal transmission unit transmitting a detonator detection signal to the plurality of electronic delay detonators through the trunk line when the logging mode is operated;

a detection reception response signal reception unit receiving a detonator detection reception response signal for a detonator detection signal transmitted from at least one electronic delay detonator to which the log counter is not assigned among the plurality of electronic delay detonators;

a log counter transmission unit issuing and transmitting the log counter to at least one of the electronic delay detonators when the detonator detection reception response signal is received;

a counter reception response signal reception unit receiving a counter reception response signal for a log counter reception transmitted from at least one of the electronic delay detonators that receives and records the log counter; and a logging mode termination unit terminating the logging mode via user operation, wherein the electronic delay detonator logging control device is integrated with the controller and the device is interconnected to the trunk line that is connected to the plurality of electronic delay detonators, wherein the counter reception response signal reception unit includes:

a signal number counting unit counting a number of detonator detection reception response signals received;

a counter deletion request signal transmission unit transmitting a counter deletion request signal for deleting a recently issued log counter to at least one of the electronic delay detonators when two or more counter reception response signals are received for the log counter reception; and a counter deletion performance signal reception unit receiving a counter deletion performance signal for the counter deletion request signal transmitted from at least one of the electronic delay detonators that receives the counter deletion request signal.

2. The device of claim 1, wherein the log counter transmission unit issues the log counter including a unique ID for the controller and a sequence of the log counter.

3. The device of claim 1, wherein when the logging mode is terminated by user, the logging mode termination unit transmits a logging mode termination instruction to the plurality of electronic delay detonators so that the electronic delay detonators receiving the instruction switch to an operation standby mode.

4. The device of claim 1, further comprising:

a logging recovery mode operation unit operating a logging recovery mode when a failure occurs in the controller and a new controller is connected to the trunk line.

5. The device of claim 4, wherein the logging recovery mode operation unit includes:

a counter repeat instruction transmission unit transmitting a counter repeat instruction signal to the plurality of electronic delay detonators through the trunk line when the logging recovery mode is operated; and a log counter repeat signal reception unit receiving and recording a log counter repeat signal transmitted from the electronic delay detonator in a predetermined sequence.

6. The device of claim 5, wherein the logging mode operation unit operates the logging mode for the controller when the log counter repeat signal is received.

7. The device of claim 1, wherein the electronic delay detonator includes:

an activation mode operation unit connected in parallel to the trunk line and operating in an activation mode to perform charging within a predetermined time when the logging mode is operated;

a state checking unit checking whether the log counter is assigned when the charging is completed;

a detection response signal transmission unit transmitting the detonator detection reception response signal for the detonator detection signal when the log counter is not assigned and not transmitting the detonator detection reception response signal for the detonator detection signal when the log counter is assigned;

a log counter receiving unit receiving and recording the log counter when the log counter is not assigned, and ignoring the log counter when the log counter is assigned;

a counter reception response signal transmission unit transmitting the counter reception response signal for the log counter reception when the log counter is received and recorded; and an operation standby mode switching unit terminating the activation mode and switching to an operation standby mode, when the logging mode is terminated.

8. The device of claim 7, wherein the electronic delay detonator includes:

a counter deletion performance unit deleting a corresponding log counter upon receiving and recording the corresponding log counter when the counter deletion request signal for deleting the recently issued log counter is received; and a counter deletion performance signal transmission unit transmitting a counter deletion performance signal for the counter deletion request signal after the deleting of the log counter.

9. The device of claim 7, wherein the electronic delay detonator includes:

a correction standby mode switching unit operating in a logging recovery mode and receiving a counter repeat instruction signal; and a counter repeat signal transmission unit transmitting a log counter repeat signal in a predetermined sequence.

10. The device of claim 7, wherein the electronic delay detonator further includes a log counter issue request signal transmission unit for transmitting a log counter issue request signal to the log counter transmission unit when it is recognized that the controller is set to a reception mode, so that, when the log counter is not assigned, the log counter transmitted from the log counter transmission unit that receives the log counter issue request signal is received and recorded through the log counter receiving unit.

11. An electronic delay detonator logging control method, the method comprising:

by a logging mode operation unit, operating a logging mode when a controller is interconnected with a trunk line connected to a plurality of electronic delay detonators, at least one electronic delay detonator among the plurality of electronic delay detonators is not assigned a log counter, the other electronic delay detonators are assigned the log counter;

by a detonator detection signal transmission unit, transmitting a detonator detection signal to the plurality of electronic delay detonators through the trunk line when the logging mode is operated;

by a detection reception response signal reception unit, receiving a detonator detection reception response signal for a detonator detection signal transmitted from at least one electronic delay detonator to which the log counter is not assigned among the plurality of electronic delay detonators;

by a log counter transmission unit, issuing and transmitting the log counter to at least one of the electronic delay detonators when the detonator detection reception response signal is received;

by a counter reception response signal reception unit, receiving a counter reception response signal for a log counter reception transmitted from at least one of the electronic delay detonators that receives and records the log counter; and by a logging mode termination unit, terminating the logging mode via user operation, wherein an electronic delay detonator logging control device is integrated with the controller and the device is interconnected to the trunk line that is connected to the plurality of electronic delay detonators, wherein after the reception of the counter reception response signal for the log counter reception transmitted from at least one of the electronic delay detonators that receives and records the log counter, further comprising:

counting a number of detonator detection reception response signals received;

transmitting a counter deletion request signal for deleting a recently issued log counter to at least one of the electronic delay detonators when two or more counter reception response signals are received for the log counter reception; and receiving a counter deletion performance signal for the counter deletion request signal transmitted from at least one electronic delay detonator that receives the counter deletion request signal.

12. The method of claim 11, after the operating of the logging mode when the controller is interconnected with the trunk line connected to the plurality of electronic delay detonators, further comprising:

allowing the electronic delay detonator to be connected in parallel to the trunk line and operating in an activation mode to perform charging within a predetermined time when the logging mode is operated;

allowing the electronic delay detonator to check whether the log counter is assigned when the charging is completed;

allowing the electronic delay detonator to transmit the detonator detection reception response signal for a detonator detection signal when the log counter is not assigned and not transmit the detonator detection reception response signal for the detonator detection signal when the log counter is assigned;

allowing the electronic delay detonator to receive and record the log counter when the log counter is not assigned, and ignore the log counter when the log counter is assigned;

allowing the electronic delay detonator to transmit the counter reception response signal for the log counter reception when the log counter is received and recorded; and allowing the electronic delay detonator to terminate the activation mode and switch to an operation standby mode when the logging mode is terminated.

13. The method of claim 11, after the reception of the counter reception response signal for the log counter reception transmitted from at least one of the electronic delay detonators that receives and records the log counter, further comprising:

allowing the electronic delay detonator to delete a corresponding log counter upon receiving and recording the corresponding log counter when the counter deletion request signal for deleting the recently issued log counter is received; and allowing the electronic delay detonator to delete the log counter and then transmit a counter deletion performance signal for the counter deletion request signal.

14. The method of claim 11, after the terminating of the logging mode when the counter reception response signal is received, further comprising:

operating a logging recovery mode when a failure occurs in the controller and a new controller is connected to the trunk line, wherein the operating of the logging recovery mode when the failure occurs in the controller and the new controller is connected to the trunk line includes:

transmitting a counter repeat instruction signal to the plurality of electronic delay detonators through the trunk line when the logging recovery mode is activated; and receiving and recording a log counter repeat signal transmitted from the electronic delay detonator in a predetermined sequence.

15. The method of claim 11, after the terminating of the logging mode when the counter reception response signal is received, further comprising:

allowing the electronic delay detonator to operate in a logging recovery mode to receive a counter repeat instruction signal; and allowing the electronic delay detonator to transmit a log counter repeat signal in a predetermined sequence.

* * * * *